US005442564A

United States Patent [19]

Merlini et al.

[11] Patent Number: 5,442,564

[45] Date of Patent: Aug. 15, 1995

[54] METHOD FOR DETERMINING THE SIZE OF THE STITCH LOOPS IN SOCK-PRODUCTION MACHINES

[75] Inventors: Marco Merlini; Daniele Vivoli, both of Florence, Italy

[73] Assignee: Savio S.p.A., Pordenone, Italy

[21] Appl. No.: 786,565

[22] Filed: Nov. 1, 1991

[30] Foreign Application Priority Data

Nov. 7, 1990 [IT] Italy ..... 21992A/90

[51] Int. Cl.[6] ..... D04B 9/46

[52] U.S. Cl. ..... 364/470; 66/54; 66/232

[58] Field of Search ..... 364/470; 66/54, 55, 66/81, 77

[56] References Cited

U.S. PATENT DOCUMENTS

| | | | |
|---|---|---|---|
| 4,527,402 | 7/1985 | Swallow et al. . | |
| 4,567,737 | 2/1986 | Lonati . | |
| 4,712,390 | 12/1987 | Lonati | 66/54 |
| 4,934,161 | 6/1990 | Güell | 66/54 |
| 5,016,449 | 5/1991 | Negri | 66/54 |
| 5,174,132 | 12/1992 | Brandani | 66/54 |

FOREIGN PATENT DOCUMENTS 3232643 3/1984 Germany .

2193230A 2/1988 United Kingdom .

*Primary Examiner*—Roy N. Envall, Jr.
*Assistant Examiner*—Brian C. Oakes
*Attorney, Agent, or Firm*—George P. Hoare, Jr.; Rogers & Wells

[57] ABSTRACT

A method for determining the size of the stitch loops in sock-production machines by means of a control unit which stores three pairs of values for each of a plurality of different types of yarns with which each of a plurality of machine zones is to be produced. Each pair of values includes the relative height and the corresponding width of the knitted product, the specific length and corresponding width of the knitted product, and the height of the stitch-formation triangles and corresponding specific length of the knitted product. The width and type of yarn is selected for each zone to be produced, and the relative height corresponding to the selected width and type of yarn for each zone is determined by the control unit by means of an equation which represents a straight line. The rotational speed and angular position of the machine cylinder is measured and fed to the control unit, which then sends signals to step motors. The value for the width stored in the control unit is derived by an autocalibration procedure which utilizes an equation which represents a straight line.

5 Claims, 2 Drawing Sheets

METHOD FOR DETERMINING THE SIZE OF THE STITCH LOOPS IN SOCK-PRODUCTION MACHINES

BACKGROUND OF THE INVENTION

The present invention relates to a method for determining the size of the stitch loops in high-speed sock-production machines and consequently the transverse stretchability of the socks, by means of a control unit.

It is known that the width of a sock is adjusted by varying the position in height of the stitch-formation triangles. It is thus possible to vary the depth of descent of the needle below the striking surface of the sinkers and consequently the length of thread taken up by each stitch loop.

The position in height of the triangles is adjusted by two step motors:

plain-stitch motor;

purl-stitch motor.

References made below to the step motor concern the plain-stitch motor. The position of the purl-stitch motor may be deduced from that of the plain-stitch motor and from coefficient P (percentage of the purl/-plain stitches ratio)

$$P = \frac{HR}{HD}\,100;\ HR = mHD;\ m = \frac{P}{100}$$

where HR and HD are the position, in steps, of the purl-stitch motor and the position, in steps, of the plain-stitch motor respectively.

In the current state of the art, adjustment of the height is pre-set by the operator on the basis of his experience gained from numerous experiments.

The basic parameters in play for the height setting are the typology and type of the yarn, leaving the number of needles, speed of the yarn and percentage of the plain/purl-stitch ratio constant.

SUMMARY OF THE INVENTION

We have discovered a method which enables the optimum height to be determined by using a control unit which makes use of an algorithm, reducing the setting times and at the same time rendering the sock-production machine more reliable since the margin of error by the operator is also reduced. At the same time, adopting this method allows the height of the stitch-formation triangles to be changed, if necessary, without any manual intervention by the operator.

The method covered by the present invention, for determining the size of the stitch loops in sock-production machines by means of a control unit, involves the following stages:

(a) storing in the control unit information indicating, for each typology and type of yarn with which an area of the sock is to be made, two pairs each of the following three sets of values: height of the stitch-formation triangles and corresponding width of the sock; if required, the specific length and corresponding width of the sock; if required, the height of the stitch-formation triangles and corresponding specific length of the sock;

(b) selecting, for each sock area, the width, typology and type of yarn;

(c) determining, by means of the control unit, for each sock area, the height of the stitch-formation triangles by means of the following equation:

$$\frac{h - h_1}{h_2 - h_1} = \frac{l - l_1}{l_2 - l_1} \tag{1}$$

representing a straight line; where 1 is the width selected, $(h_1, l_1)$ and $(h_2, l_2)$ are the two pairs of values and h is the height of the triangles;

(d) measuring the rotational speed and the angular position of the cylinder and sending such information to the control unit;

(e) activating the motor by means of the control unit thereby adjusting the relative height between the cylinder and the cam to correspond to the relative height (h) calculated in said determining step (c); and (f) deriving the value for the width stored in the control unit by an autocalibration procedure comprising:

selecting two triangle height values;

determining the specific lengths for these height values by measuring the drawing positions; and calculating each of the two values of the corresponding knitted product widths using the following equation:

$$K * \frac{t - t_1}{t_2 - t_1} = \frac{l - l_1}{l_2 - l_1}$$

wherein t is the specific length determined by the control unit, $(t_1, \mathbf{1}_1)$ and $(t_2, \mathbf{1}_2)$ are the values of the two pairs formed by the specific length and corresponding width of the knitted product, and K is a conversion factor.

DETAILED DESCRIPTION OF THE INVENTION

The width 1 of the sock is determined by subjecting the sock to traction, in the direction of the rows, which stretches the said rows to the maximum. Special devices are already used in the hosiery industry, capable of always imparting the same tensile stress to stretch the row.

Figure 1:
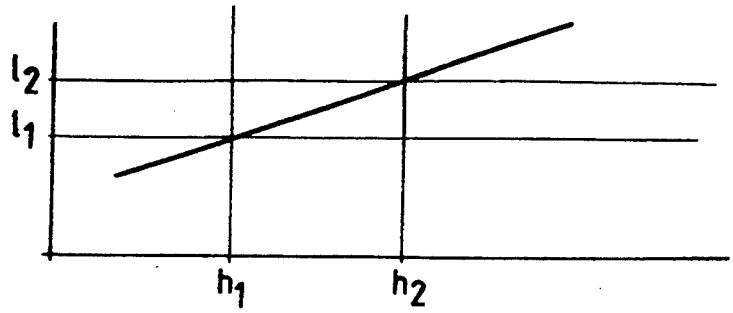
FIGS. 1, 2, 3 and 4 are graphs representing relationships between characteristics used in the preferred embodiment of the invention.

Experimental measurements have shown that the link existing between the height of the triangles and width of the sock is of a linear type, according to the graph in FIG. 1, where the width is calculated in centimeters while the height of the triangles is measured in the number of pulses to be sent to the contraction motor.

An analytical representation of this link may be obtained, in a first approximation (which proved adequate in practical applications), by measuring the width of the sock corresponding to two different triangle heights.

By means of a calibration the operator must select the following parameters:

$h_1$, $h_2$: Triangle Height (position of the step motor)

P: Percentage of the plain-/purl-stitch ratio

G: Number of turns

V: Speed of rotation.

After entering the data, two socks are manufactured: the first made with the step motors in position $h_1$, the second with the step motors in position $h_2$. Once the socks have been made, widths $l_1$ and $l_2$ are measured, for each area, and the values are entered in the memory.

Let ($l_1$, $h_1$) and ($l_2$,$h_2$) be the co-ordinates of the points in plane (l, h) of FIG. 1 corresponding to the said experimental measurements.

The equation of the straight line passing through these points is given by:

$$\frac{h - h_1}{h_2 - h_1} = \frac{l - l_1}{l_2 - l_1} \quad (1)$$

where, the said $$\Delta l = l_2 - l_1$$

$$\Delta h = h_2 - h_1$$

may be rewritten as $$h = \frac{\Delta h}{\Delta l}(l - l_1) + h_1 \quad (2)$$

It will be observed that Relation (1) is a function of the yarn count, thread type, thread tension and ambient conditions.

This Relation provides the desired operational link between triangle heights and sock width.

This link is usually different for each area, and therefore the experimental measurement described above must be repeated for each area of the sock.

A PASCAL function has been developed to determine the height corresponding to a certain width. This function is based on a knowledge of the experimental data ($l_1$, $h_1$) and ($l_2$, $h_2$) and works on the generic width l to provide the corresponding height h according to Equation (2).

To avoid using the floating-point functions library of the PASCAL computer used, the calculations relating to Equation (2) have been organised so as to use only integral arithmetic.

In particular (2) gives:

$$h = \frac{\Delta h(l - l_1) + h_1 \Delta l}{\Delta l} = \frac{N}{\Delta l} \quad (3)$$

Numerator N of Equation 3 clearly gives an integral result, whereas quotient N/Δl has been obtained by means of a rounding off operation according to the following algorithm:

$$\begin{aligned} \text{round}(N/\Delta l) &= \text{trunc}((N/\Delta l) + 0.5) \\ &= \text{trunc}((2N + \Delta l)/2\Delta l) \\ &= (2N + \Delta l)\text{div}(2\Delta l) \end{aligned}$$

where round indications the rounding off operation, trunc the truncating operation and div the integral division. It will be noted that the PASCAL round function has not been used since it forms part of the library for floating-point arithmetic.

The number of pulses to be sent to the contraction motor thus calculated is "saturated" to the maximum number of pulses that can actually be sent to that motor (mechanical constraint).

The function in PASCAL language of width/height may for example be as follows:

```
(width-->height conversion function)
converts function(i:byte;width:word):word;
var
  num,deltal,deltah:integer;
  conv1 : word;
begin
  with actart.zonea[i] do
  begin
    conv1 := maxstepr:
    deltal :=ctl2-ctl1;
    deltah:=cth2-cth1;
    if deltal <> 0 then
    begin
      num:=deltah*width+cth1*deltal-ctl1*deltah;
      conv1:=(2*num+deltal)div(2*deltal);
      if conv1 < 0 then conv1 := 1;
      if conv1 > maxstepr then conv1 := maxstepr;
      converts:=conv1;
    end
    else begin
        error := 16#50; (editor error on entering widths)
        converts:=conv1;(set convert to a valid value)
      end;
    end
end;
in which
i = Current Area
width = Programmed Width
ctl1 = Width.1 Calibration Coefficient (l1)
ctl2 = Width.2 Calibration Coefficient (l2)
cth1 = Height 1 Calibration Coefficient (h1)
cth2 = Height 2 Calibration Coefficient (h2)
```

The values of the two pairs formed by the height of the stitch-formation triangles and the corresponding specific length of the sock, are found by means of the calibration described above where the said control unit calculates the values of the specific length by the machine measuring the drawing positions.

The drawing device is a (mechanical, electrical and electronic) device used to keep the stitch under tension during its manufacture. This action is necessary for textile reasons.

Parallel to its main function, we use drawing to measure the specific lengthening of the stitch by means of a series of devices.

More particularly, we have found that it is possible for the machine to measure the drawing positions by using a position transducer device (encoder) positioned at an appropriate drawing point.

Let us assume that the drawing device is initially located in position TIR1 and that after G turns, at speed V, it is in position TIR2.

Specific lengthening t is thus defined:

$$\begin{aligned} t &= (TIR2 - TIR1)/G \\ &= \Delta TIR/G \end{aligned}$$

The machine measures the drawing positions and calculates specific lengthening t. This is possible in all the areas in which drawing is active.

Figure 2:
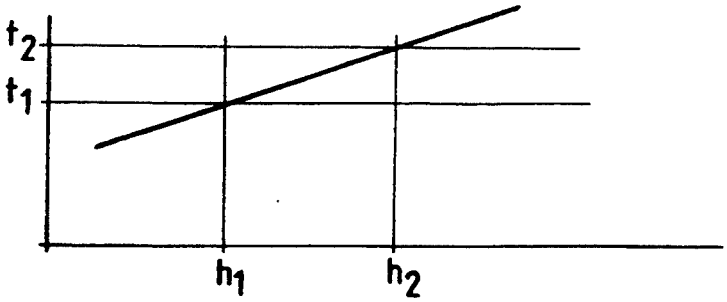

The data obtained have shown that the link existing between the specific length and the height of the stitch-formation triangles is of a linear type, according to the graph in FIG. 2, where the specific length is calculated in centimeters per turn, while the triangle height is measured in the number of pulses to be sent to the contraction motor. An analytical representation may be given, in a first approximation, by the following equation representing a straight line $$\frac{h - h_1}{h_2 - h_1} = \frac{t - t_1}{t_2 - t_1} \cdot K \quad (4)$$

in which ($h_1$) and ($h_2$) are the heights selected, ($t_1$) and ($t_2$) are the specific lengths calculated and K is a conversion factor.

Factor K has been included in (4) to convert into cm/turn the information supplied by the position transducer which is usually expressed by other units. For example, an encoder gives pulses/turn.

It will be observed that Relation (4) is a function of the yarn count, yarn type, tension and ambient conditions.

In addition to the values of the two pairs formed by the height of the stitch-formation triangles and by the corresponding specific length, it is accordingly possible to determine also the values of the two pairs formed by the specific length and corresponding width.

Figure 3:
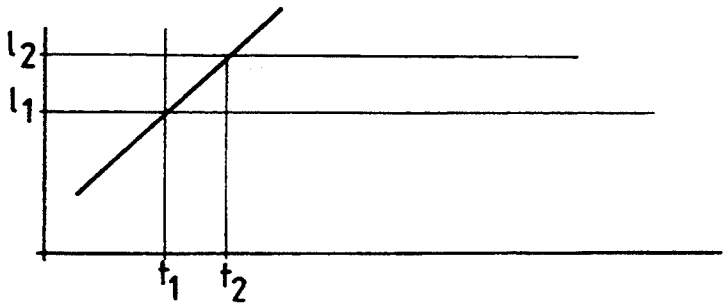

Experimental measurements have shown that, in machines with a cylinder of the same diameter and with the same number of needles (fineness), the link existing between specific length t and the stitch width of the sock is of a linear type, according to the graph in FIG. 3, where the width is calculated in centimeters while the specific length is measured in cm/turns of cylinder. Furthermore, this relation is essentially independent of the yarn count, unwinding tension and working conditions.

An analytical representation may be given, in a first approximation, by the following equation representing a straight line:

$$K \cdot \frac{t - t_1}{t_2 - t_1} = \frac{l - l_1}{l_2 - l_1} \quad (5)$$

in which ($l_1$, $t_1$) and ($l_2$, $t_2$) are the values found by means of the above-described calibration and by consequently determining the specific lengths and K is a conversion factor.

Experimental measurements have shown that the straight lines (l,t) associated with different selections form a band F of straight lines which are almost parallel and very close together. For this reason the average straight line of the band may be replaced by any other straight line of F with an error which, in the practical applications to which we refer, may be widely tolerated.

The meaning of the expression different selections may be explained correctly in the following way: let us consider a machine with N needles. For example, if N/2 needles work on the plain stitches and N/2 needles work on the purl stitches, the selection is said to be 1:1. If 3N/4 needles work on the plain stitches and N/4 on the purl stitches, the selection is 3:1.

We have already said that, with the same number of needles and cylinder diameter, the straight lines (l−t) remain very similar on varying the selection and yarn.

When the parameters of straight lines for several yarns (of the same typology) are available it is possible to calculate, for each area, a characteristic average straight line of the typology.

For this reason the machine can perform automatic calibration (autocalibration). In other words, the user avoids the calibration procedure previously described by taking the data of the average straight line as a basis.

Autocalibration is particularly useful in machines capable of manufacturing socks with embroidered patterns. Indeed the presence of the pattern stitch makes measurement of the width problematical.

Autocalibration whereby the values of the two pairs formed by the height of the stitch-formation triangles and corresponding sock width are found, to be stored in the control unit, occurs as described below.

Two values of cylinder height are selected ($h_1$) and ($h_2$), then the control unit determines operationally specific lengths ($t_1$) ($t_2$) by means of the measurement by the machine of the drawing positions and calculates each of the two values of the corresponding sock width (l) by means of the following equation:

$$K \cdot \frac{t - t_1}{t_2 - t_1} = \frac{l - l_1}{l_2 - l_1} \quad (5)$$

previously described above, representing a straight line, where t is the specific length determined by the control unit, ($t_1$, $l_1$) and ($t_2$, $l_2$) are the values of the two pairs formed by the specific length and corresponding width of the sock.

The method covered by the present invention also enables the various triangle heights for the shaped areas of the sock to be determined.

Indeed, on occasion the width of an area of the sock may not remain constant but vary. Currently, in this situation, the operator must intervene by presetting, after a certain number of turns, the increase in height but this results in a more or less obvious "stepped" effect.

With the above-described method two widths are selected for each shaped area, the greater and the lesser, determining by means of the control unit, using Equation ( 1), the corresponding initial and final heights, the intermediate heights being extrapolated by the control unit by means of an algorithm which makes the width vary gradually.

In this way the triangle heights could be varied even between one turn and the next.

Another object of the present invention is the procedure for the control and possible operational correction of the width programmed for individual shaped areas of the sock, modifying the height of their stitch-formation triangles purely by means of the control unit.

The expression "operational correction" means a sequence of actions aimed at obtaining a stitch width with characteristics as close as possible to those achieved in the various areas of the sock during calibration or autocalibration.

Experience shows that the dimensions of the socks manufactured are rather variable even if the parameters on which, in theory, such changes depend are not modified. These parameters include all the functions controlled by the electronic part and the mechanical characteristics of the machine.

There are also other parameters which cannot be regarded as constant not even in theory; these include the type and tension of the yarn, temperature and air humidity.

The method of checking and possible modification of the height of the stitch-formation triangles determined previously, is performed by the control unit which calculates for the same area of the sock the specific length, works out from measurements made by the machine itself during manufacture of the sock, the drawing positions, compares the above-calculated specific length value ($t_v$) obtained with the value of the specific length ($t_p$) obtained by means of the following equation:

$$\frac{h-h_1}{h_2-h_1}=\frac{t-t_1}{t_2-t_1}\cdot K \tag{4}$$

described above, in which $t=t_p$ and h is the operational height, changes, only if the specific length values fail to coincide ($t_v=t_p$), the value of the height of the stitch-formation triangles by means of an algorithm based on a straight line having the same angular coefficient as the straight line in Equation (4) passing through a point having as its coordinates the specific length calculated above and the height determined by means of Equation ( 1), from which straight line a new cylinder height is found corresponding to the specific length obtained by means of Equation (4).

Figure 4:
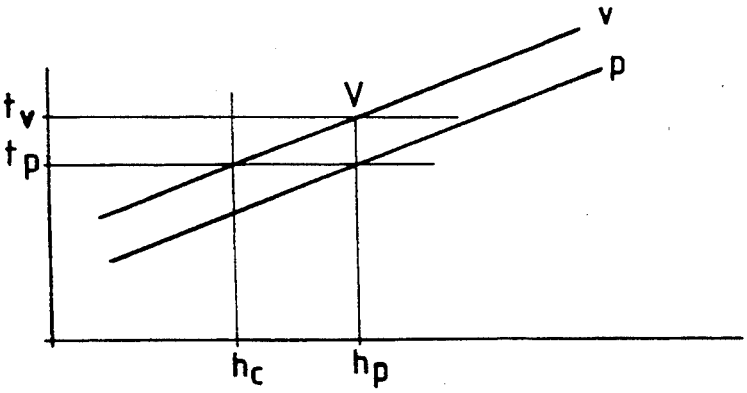

In order better to illustrate the said procedure of control and possible correction we shall refer to the graph in FIG. 4.

Straight line (P) is the straight line calculated by means of Equation (4): given the programmed height ($h_p$) the corresponding specific length ($t_p$) is obtained. The control unit calculates a length ($t_v$) different from that programmed.

A new working straight line ($v_t$) parallel to the previous one and passing through point V ($t_v$,$t_p$) must then be used thus determining a new corresponding height ($h_c$) to obtain the specific length ($l_p$).

The measurements made and the values of the magnitudes involved allow us to assume that p and v are parallel straight lines.

To recapitulate, the data involved in the operational correction are taken from linear relations. These straight lines have two origins:

calibration or autocalibration;

drawing.

Operational correction in the case of autocalibration presents different aspects to the case of calibration. Indeed, whereas with calibration straight lines (l−h) and (t−h) become available, with autocalibration straight line (t−h) becomes available, and from the data of the typologies, straight line (l−t) is known. These last two straight lines, however, are sufficient to find straight line (l−h) and bring calculation back to the case of calibration.

We would point out that operational correction is possible only in those areas in which drawing is active; this is not restrictive since it is precisely in these areas that operational correction is necessary and effective.

Two examples are now given which show the algorithm used to determine a characteristic width/length straight line of the typology and the algorithm used for operational correction of the height.

EXAMPLE 1

Algorithm for determining a characteristic specific length/width straight line of the typology.

There are a finite number of points ($x_i$, $y_i$) through which we wish to determine an interpolating straight line.

We shall approach the problem of the best approximation (b.a.) in the sense of minimum squares.

Given N points of the plane:

($x_i$,$y_i$) i=1 ,. . . ,N

The b.a. in the sense of minimum squares consists in determining the n-multiple $a=(a_1, a_2, \ldots, a_n)$ for which, assuming $$L(a,x)=\sum_{k=1}^{n} a_k * v_k(x)$$

means:

$$\sum_{i=1}^{N}[L(\widehat{a,x})-y_i]^2 \leqq \sum_{i=1}^{N}[L(\widehat{a,x})-y_i]^2$$

It emerges that to determine a the following system must be resolved:

$$M\hat{a}=r \tag{1}$$

being $$m_{ij}=\sum_{k=1}^{N} v_i(x_k) * v_j(x_k)$$

$$r_i=\sum_{k=1}^{N} v_i(x_k) * y_k$$

In the case of linear approximation n=2; [1]becomes:

$$\begin{bmatrix} m_{11} & m_{12} \\ m_{21} & m_{22} \end{bmatrix}\cdot\begin{bmatrix} \hat{a}_1 \\ \hat{a}_2 \end{bmatrix}=\begin{bmatrix} r_1 \\ r_2 \end{bmatrix}$$

let us select $v_1(x)=1$ $v_2(x)=x$ then $$m_{11}=\sum_{k=1}^{N} 1=N$$

$$m_{12}=m_{21}=\sum_{k=1}^{N} x_k$$

$$m_{22}=\sum_{k=1}^{N} x_k^2$$

$$r_1=\sum_{k=1}^{N} f_k$$

$$r_2=\sum_{k=1}^{N} x_k * f_k$$

The best linear approximation is given by $f(x)$:$Ax+B$ obtained by resolving:

$$\begin{bmatrix} m_{11} & m_{12} \\ m_{21} & m_{22} \end{bmatrix}\cdot\begin{bmatrix} A \\ B \end{bmatrix}=\begin{bmatrix} r_1 \\ r_2 \end{bmatrix}$$

Thus $$B=\frac{r_1 * m_{22}-r_2 * m_{12}}{m_{11} * m_{22}-m_{21} * m_{12}}=\frac{\delta B}{\delta}$$

$$A=\frac{r_2 * m_{11}-r_1 * m_{21}}{m_{11} * m_{22}-m_{21} * m_{12}}=\frac{\delta A}{\delta}$$

The aim is to achieve the previous algorithm by making use of integral arithmetic only without using the PASCAL computer's floating-point library.

There are two main problems:

the values of the elements of the matrix of the coefficients and vector of the known terms must remain within the field of integers:

I=−2147483648, 2147483647

The problem is twofold:

Calculating $m_{22}$ and $r_2$.

As regards single values there is no other method which sets limits on the number of points and on the values of their coordinates. The values adopted in practice guarantee this point.

1.2 calculating δB in which the following products appear $m_{22}*r_1$ $m_{12}*r_2$ We may use the following algorithm:

$$\delta B = r_1 * m_{22} - r_2 * m_{12}$$

$$= \sum_{i=1}^{N} y_i * \sum_{r=1}^{N} x_r x_r - \sum_{j=1}^{N} x_j y_j * \sum_{k=1}^{N} x_k$$

$$= \sum_{i,r}^{N} y_i x_r x_r - \sum_{j,k}^{N} y_j x_j x_k$$

$$= \sum_{j,k}^{N} y_j x_k x_k - \sum_{j,k}^{N} y_j x_j x_k$$

$$= \sum_{j,k}^{N} y_j x_k (x_k - x_j).$$

The two sole divisions required by algorithm A/and B/ must save information to at least two decimal points (although they are integral divisions).

The method followed is to multiply the dividend by 100 so that, despite integral division, the information is kept to the first two decimal points.

Since there are overflow problems even without multiplication by 100, the following algorithm is used which does not introduce additional limitations.

If the values of divisor D and dividend N are within the range of the permitted values, the following algorithm does not produce an overflow:

1) Q=N div D /* integral division */

2) R=N mod D /* remainder of integral division

Rp=(R * 100) div D

4) Qp=(Q*100)+Rp

Qp is an integral number in which the units digit and the tens digit represent, respectively, the hundredth part and decimal part of the quotient; in other terms:

$$Qp=INT(Q/N)*100$$

Algorithm for Operational Correction of Height. Let m be the angular coefficient of straight line (FIG. 4) clearly, from calibration:

$$m = \frac{t_2 - t_1}{H_2 - H_1}$$

The straight line p is described by an equation such as:

$$t=m*h+n$$

the straight line v $$t=m*h+n^1$$

Hp has been entered by the user;

Tv is calculated on the basis of measurements made by the machine itself.

Straight line v (parallel to p) is determined by calculating $n^1$:

$$T_v m = *H_p + n^1$$

$$n^1 = T_v - m*H_p$$

Thus $$t=m*h+(T_v-m*H_p)$$

The position in which to place the motor in order to maintain what has been programmed is easy to calculate:

$$T_p=m*H_c+(T_v-m*H_p)$$

$$H_c=T_p-T_v+m*H_p$$

Figure 5:
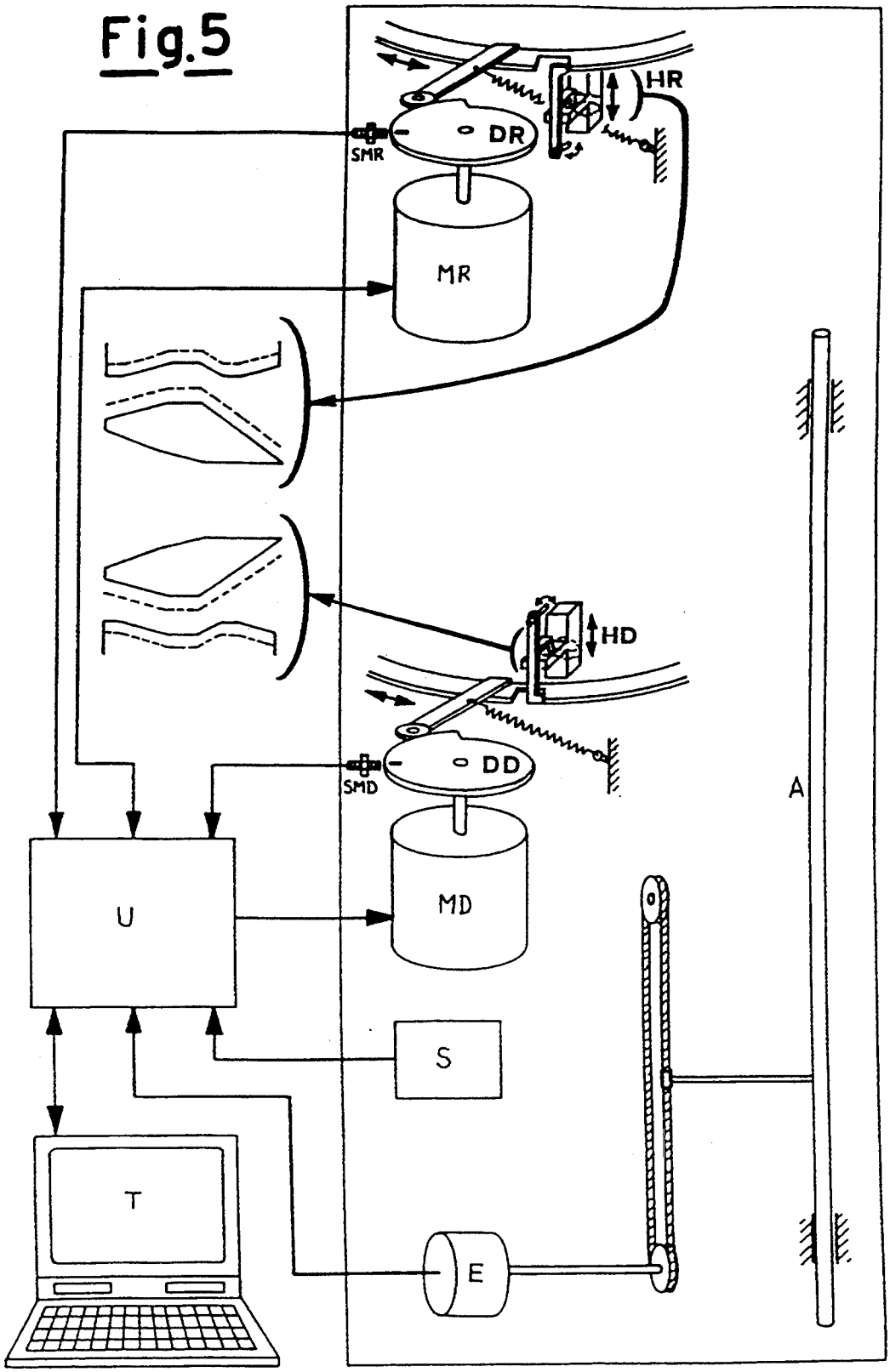
FIG. 5 is a representation of a knitting device used in the invention.

We shall now illustrate the practical nature of the invention by means of the diagram in FIG. 5.

Control unit (U) is supplied by terminal (T) with the parameters, from sensors (SMR) and (SMD) the "zero" reference of discs DR and DD and from sensor (S) the information on the cylinder/machine synchronism.

The control unit gives the commands to step motors (MR) and (MD) onto whose drive shafts are splined disc (DR) and disc (DD) respectively which by means of linkages modify the corresponding values of height (HR) and height (HD) of the triangles.

The said diagram also shows drawing rod (A) and drawing encoder (E).

We claim:

1. In an automatic knitting machine having a plurality of zones, a needle cylinder, and a stitch forming cam, a method of adjusting the relative height between the cylinder and the cam in a corresponding zone for varying the stitch loop size, wherein the machine has a control unit and a motor operatively connected therewith for adjusting the relative height, and wherein the method comprises the steps of:

a) storing three sets of values in the control unit for each of a plurality of different types of yarns with which each zone is to be produced, wherein the three sets of values include two pairs of values for the relative height and a corresponding width of a knitted product, two pairs of values for a specific length and corresponding width of the knitted product, and two pairs of values for a height of stitch-formation triangles and corresponding specific length of the knitted product;

b) selecting a width and a type of yarn for each zone to be produced;

c) determining a relative height, h, corresponding to said selected width and said selected type of yarn for each zone by means of the control unit using the following equation:

$$\frac{h - h_1}{h_2 - h_1} = \frac{l - l_1}{l_2 - l_1}$$

wherein ($h_1$, $l_1$) and ($h_2$, $l_2$) are pairs of values associated with said selected type of yarn, l is said selected width, and h is the relative height;

d) measuring a rotational speed and angular position of the cylinder and feeding said speed and position to the control unit;

e) activating the motor by means of the control unit and adjusting the relative height between the cylinder and the cam to correspond to the relative height (h) calculated in said determining step (c); and f) deriving the value for the width of said knitted product stored in the control unit by an autocalibration procedure comprising:

selecting two triangle height values;

determining the specific lengths for these height values by measuring the drawing positions; and calculating each of the two values of the corresponding knitted product widths using the following equation:

$$K * \frac{t - t_1}{t_2 - t_1} = \frac{l - l_1}{l_2 - l_1}$$

wherein t is the specific length determined by the control unit, ($t_1$, $l_1$) and ($t_2$, $l_2$) are the values of the two pairs formed by the specific length and corresponding width of the knitted product, and K is a conversion factor.

2. The method of claim 1, further comprising deriving the pairs of values formed by the height of the stitch-formation triangles and corresponding knitted product widths to be stored in the control unit by a calibration step comprising selecting two triangle-height values and then measuring the corresponding knitted product widths obtained.

3. The method of claim 1, wherein at least one zone has a width differing from other zones, and wherein said at least one zone has a major width and a minor width, further comprising:

selecting the major width and minor width during said selection step (b);

determining the relative height corresponding to said major width and selected minor width during said determining step (c);

determining intermediate heights by extrapolation using the relative heights determined for said selected major and minor widths.

4. The method of claim 1 further comprising:

measuring the specific length of a zone on a knitted product;

comparing said measured length with the corresponding stored specific length for that zone; and adjusting the stored pairs of values with the new pair of values when the measured specific length of a zone differs from the corresponding stored length, wherein the new pair of values includes said determined relative height and said measured specific length.

5. The method of claim 1, further comprising measuring the drawing positions using a position transducer device positioned at a drawing point.

* * * * *